US005788782A

United States Patent [19]

Kaneko et al.

[11] Patent Number: 5,788,782

[45] Date of Patent: Aug. 4, 1998

[54] R-FE-B PERMANENT MAGNET MATERIALS AND PROCESS OF PRODUCING THE SAME

[75] Inventors: Yuji Kaneko, Uji; Naoyuki Ishigaki; Koki Tokuhara, both of Ootsu, all of Japan

[73] Assignee: Sumitomo Special Metals Co., Ltd., Osaka, Japan

[21] Appl. No.: 512,951

[22] Filed: Aug. 9, 1995

Related U.S. Application Data

[62] Division of Ser. No. 135,559, Oct. 14, 1993, abandoned.

[51] Int. Cl.[6] ..... H01F 1/032

[52] U.S. Cl. ..... 148/103; 148/101; 148/104; 148/122

[58] Field of Search ..... 148/101, 103, 148/104, 122

[56] References Cited

U.S. PATENT DOCUMENTS

| | | | |
|---|---|---|---|
| 4,564,400 | 1/1986 | Narasionhan et al. | 148/103 |
| 4,678,634 | 7/1987 | Tawara et al. | 148/103 |
| 4,898,625 | 2/1990 | Otsuka et al. | 148/101 |
| 5,123,979 | 6/1992 | Tenaud et al. | 148/302 |
| 5,125,990 | 6/1992 | Iwasaki et al. | 148/302 |
| 5,213,631 | 5/1993 | Akioka et al. | 148/302 |
| 5,221,368 | 6/1993 | Gabriel et al. | 148/101 |
| 5,230,751 | 7/1993 | Endoh et al. | 148/302 |
| 5,314,548 | 5/1994 | Panchanathan et al. | 148/101 |
| 5,405,455 | 4/1995 | Kusoroki et al. | 148/103 |

*Primary Examiner*—John Sheehan

*Attorney, Agent, or Firm*—Watson Cole Stevens Davis, P.L.L.C.

[57] ABSTRACT

It is an object of the present invention to provide R-Fe-B permanent magnet materials having a good oxidation resistance and magnetic characteristics, and a process of producing the same capable of pulverizing efficiently, whereby an R-Fe-B molten alloy having a specific composition is casted into a cast piece having a specific plate thickness and a structure, in which an R-rich phase is finely separated below 5 μm, by a strip casting process, the cast piece is subjected to a Hydrogenation for spontaneous decay, and thereafter, an alloy powder is dehydrogenated and stabilized for pulverization so as to fractionize crystal grains of a main phase constituting an alloy ingot, thereby the powder having a uniform grain distribution can be produced at an efficiency of about twice as much as the conventional process, and the R-rich phase and an $R_2Fe_{14}B$ phase are also fractionized at the time of pulverization, thus by magnetization by pressing after the orientation using a pulse magnetic field, a high performance R-Fe-B permanent magnet having, a good oxidation resistance and magnetic characteristics of the magnet alloy, particularly, a total value A+B of a maximum energy product value (BH) max (MGOe); A and a characteristic value; B of a coercive force iHc (kOe) of 59 or more and the squareness of demagnetization curve $\{(Br^2/4)/(BH)\ max\}$ of 1.01 to 1.045 is obtained.

38 Claims, 1 Drawing Sheet

R-FE-B PERMANENT MAGNET MATERIALS AND PROCESS OF PRODUCING THE SAME

CROSS-REFERENCE TO RELATED APPLICATIONS

This is a divisional of application Ser. No. 08/135,559, filed Oct. 14, 1993, now abandoned.

BACKGROUND OF THE INVENTION

1. FIELD OF THE INVENTION

The present invention relates to permanent magnet materials composed mainly of R (where R is at least one kind of rare earth element, including Y), Fe and B, and a process of producing the same. More particularly, it relates to R-Fe-B permanent magnet materials and a process of producing the same whereby a cast alloy having a homogeneous structure in which an $R_2Fe_{14}B$ phase and an R-rich phase are finely separated, or whereby an adjusting alloy cast piece containing a main phase alloy containing an $R_2Fe_{14}B$ phase as a main phase and an $R_2Fe_{17}$ phase or an R-Co intermetallic compound phase, are obtained from a molten alloy whose main components are R, Fe and B by a strip casting process. The strip casting process can be a single roll process or a double roll process and the like wherein the cast alloy is subjected to spontaneous decay by hydrogenation of the alloy, and then stabilized by dehydrogenation so as to enable the efficient pulverization, molding and sintering single powders or blended powders which are oriented by applying a pulse magnetic field. A high performance R-Fe-B permanent magnet having a total value A+B of 59 or more, in which A is a maximum energy product value (BH) max (MGOe) and B is a coercive force iHc(kOe) and the squareness of demagnetization curve $\{(Br^2/4)/(BH)max\}$ of 1.01 to 1.045, is obtained.

2. The Prior Art

Modern R-Fe-B permanent magnets (Japanese Patent Application Laid Open No. Sho 59-46008) are typical high performance permanent magnets which have high magnetic characteristics. These magnets are formed of material having a main phase of ternary tetragonal compounds and an R-rich phase. These magnets are used in many applications, including general domestic electric appliances and peripheral equipment used with largesized computers. Thus, R-Fe-B permanent magnets having various structures and exhibiting various magnetic characteristics are known.

However, due to the demands imposed by the development of small-sized, light and highly functional electric and electronic equipment, inexpensive R-Fe-B permanent magnets with a higher performance are required.

In general, a residual magnetic flux density (Br) of an R-Fe-B sintered magnet can be expressed as the following Equation (1).

$$Br \propto (Is \cdot \beta) \cdot f \cdot \{\rho/\rho O \cdot (1-\alpha)\}^{2/3} \quad (1)$$

where, Is: saturation magnetization

β: temperature dependability of Is f: Degree of orientation

ρ: density of sintered body

ρO: theoretical density

α: volume fraction of grain boundary phase (volume fraction of non-magnetic phase)

Thus, in order to raise the residual magnetic flux density (Br) of an R-Fe-B sintered magnet, 1) the volume fraction of the $R_2Fe_{14}B$ matrix phase must be increased, 2) the density must be raised to the theoretical density, and further, 3) the degree of orientation of the main phase crystal grains in an easily magnetizing axial direction must be enhanced.

That is, though it is important to bring the magnet composition close to a stoichiometrical composition of the abovementioned $R_2Fe_{14}B$ to achieve the item 1), when the R-Fe-B sintered magnet is produced from an alloy ingot as a starting material, which is prepared by melting the alloy having the aforementioned composition and casting in a mold, since α-Fe crystallized in the alloy ingot and the R-rich phase are locally segregated, it is difficult to pulverize the ingot to fine powders, and the composition changes during pulverizing with oxidation.

Particularly described in the case of mechanically pulverizing the alloy ingot after the hydrogenation and debydrogenation (Japanese Patent Application Laid Open Nos. Sho 60-63304 and Sho 63-33505), α-Fe crystallized on the alloy ingot remains as it is at the time of pulverization and hinders the pulverization by its ductility, and the R-rich phase which has omnipresented locally and becomes fine by the hydrogenation produces hydrides, so that oxidation is accelerated at the time of mechanical pulverization, or in the case of pulverization by a jet mill, causing composition discrepancies by dispersing dominantly.

When producing a sintered body by using an alloy powder which is brought close to the stoichiometrical composition of $R_2Fe_{14}B$ to achieve the item 1), in the sintering process, a Nd-rich phase for causing the liquid phase sintering produces oxides and is consumed by the inevitable oxidation, sintering is hindered, and since the Nd-rich phase and B-rich phase are inevitably decreased by increase of the $R_2Fe_{14}B$ phase, the production of sintered body becomes more difficult. Besides, the coercive force (iHc), which is one of the indexes showing a stability of the permanent magnet materials and one of the important properties, is deteriorated.

Furthermore, as to the item 3), usually in a process of producing the R-Fe-B permanent magnet, in order to make the direction of easy magnetization axes of the main phase crystal grains uniform, a process of press molding in the magnetic field has been adopted. In that case, it is known that a residual magnetic flux density (Br) value and a value of the squareness of demagnetization curve $\{(Br^2/4)/(BH)max\}$ change depending on the magnetic field applying direction and the pressing direction, or are influenced by the applied magnetic field intensity.

Recently, for preventing the crystal grains from becoming coarse, residue and segregation of α-Fe which are detrimental to R-Fe-B alloy powders by an ingot pulverizing process, whereby a cast piece having a specific thickness is formed from an R-Fe-B molten alloy by the double roll casting method. According to a usual powder metallurgical process, the cast piece is ground coarsely by means of a stamp mill, a jaw crusher and the like, and further, pulverized into powders having a mean grain size of 3 to 5 μm by a mechanical pulverizing process such as a disk mill, a ball mill, attriter, a jet mill and the like. Thereafter, the powder is pressed in the magnetic field, sintered, and annealed (Japanese Patent Application Laid Open No. Sho 63-317643).

However, in this process, as compared with the conventional case of pulverizing process of ingot casted in a mold, a pulverizing efficiency at the time of pulverization can not be improved remarkably. In addition, at the time of pulverization, since not only the grain boundary pulverization but also the intergranular pulverization occurs, the magnetic characteristics can not be largely improved, and since the R-rich phase is not in a stable $RH_2$ phase against oxidation, or since the R-rich phase is fine and has a large surface area, it is poor in oxidation resistance, thus the oxidation proceeds during the process and the high characteristics can not be obtained.

Recently, demands on the cost reduction of the R-Fe-B permanent magnet materials are becoming stronger, thus it is very important to manufacture a high performance permanent magnet efficiently. Hence, manufacturing conditions for drawing out extreme characteristics must be improved.

We have repeated various studies on processes of producing the R-Fe-B permanent magnet efficiently and improving the magnetic characteristics.

Enhancement of the residual magnetic flux density (Br) of the R-Fe-B sintered magnet can be achieved by increasing the content of the $R_2Fe_{14}B$ phase of the main phase which is the Ferro magnetic phase. That is, it is important to make the magnet composition close to the stoichiometric composition of $R_2Fe_{14}B$.

However, when producing the $R_2Fe_{14}B$ sintered magnet from the alloy ingot, prepared by melting the alloy having the aforementioned composition and casting in the mold, as the starting material, as α-Fe crystallized on the alloy ingot and the R-rich phase omnipresents locally particularly, it is difficult to pulverize and results in composition discrepancies.

Also, when producing an alloy powder having the aforementioned composition by a direct reducing and diffusing process, un-reacted Fe grains are present, and when raising the reduction temperature to eliminate this, the grains grow by sintering with one another; besides, Ca added as a reducing agent and its oxides are taken in, thereby increasing impurities.

Therefore, as the result of various studies made to resolve such problems related to the production of alloy materials, we have found out that, by using a strip casting process for rapid cooling and solidifying of the molten alloy, crystallization of the α-Fe can be suppressed and an alloy cast piece having a fine grain and homogeneous composition can be produced.

The R-Fe-B sintered magnet is sintered by a liquid-phase sintering reaction. That is, in the magnet, besides the $R_2Fe_{14}B$ phase which is the main phase and Ferro magnetic phase, the B-rich phase and R-rich phase as the grain boundary phase are present, which reacts with one another during sintering to generate the liquid phase, thereby a densification reaction proceeds.

Thus, the B-rich phase and the R-rich phase are indispensable phases for producing the R-Fe-B sintered magnet. However, in order to improve the magnetic characteristics, it is necessary to increase the $R_2Fe_{14}B$ phase which is the main phase and Ferro magnetic phase to the utmost, and for this purpose, it is intensive how to densify the alloy powder which is close to the stoichiometric composition of the $R_2Fe_{14}B$ phase.

SUMMARY OF THE INVENTION

It is an object of the present invention to provide high performance R-Fe-B permanent magnet materials having a total value A+B≧59 of a (BH) max value (MGOe); A and an iHc value (KOe); B and the squareness of demagnetization curve $\{(Br^2/4)/(BH)max\}$ of 1.01 to 1.045, wherein problems in producing the R-Fe-B materials are solved, efficient pulverization is made possible, oxidation resistance is high, a high iHc is realized by fining crystal grains of a magnet, and an orientation of the easy magnetization axis of the crystal grains is improved.

It is another object of the present invention to provide a process of producing R-Fe-B permanent magnet materials whereby in a liquid-phase sintering reaction, by reacting with a B-rich phase and an R-rich phase which hinders improvement of R-Fe-B permanent magnet characteristics, an $R_2Fe_{14}B$ phase of a main phase is produced to reduce the B-rich phase and the R-rich phase, the oxygen content in the alloy powder is decreased and the alloy powder having the composition responsive to various magnetic characteristics can be provided easily with a good productivity.

It is a further object of the present invention to provide a process of producing R-Fe-B permanent magnet materials whereby alloy powder which is close to stoichiometric compositions (of the $R_2Fe_{14}B$ phase) is subjected to liquid-phase sintering to obtain a high-performance R-Fe-B permanent magnet, and the alloy powder capable of supplying the liquid phase at sintering is added and blended, thereby to provide the alloy powder having the composition responsive to various magnetic characteristics efficiently.

The present invention is that, by the hydrogenation of a strip casted R-Fe-B alloy having a specific composition and thickness, the R-rich phase which is finely dispersed produces hydrides to cause volume expansion and eventual spontaneous decay of the alloy, thereafter the main phase crystal grains constituting the alloy can be pulverized and the powder having a uniform grain distribution can be produced, at this time, the R-rich phase is finely dispersed and the $R_2Fe_{14}B$ phase is also pulverized, thus when the alloy powder which is dehydrogenated and stabilized is pulverized, since a pulverizing powder is improved by about twice as much as the conventional pulverizing efficiency, the production efficiency is largely improved. By orientation using the pulse magnetic field and pressing, the R-FeB permanent magnet, in which Br, BH(max) and iHc are markedly improved, and the squareness of demagnetization curve shows a value of 1.01 to 1.045, which is brought close to a theoretical state as much as possible, can be obtained.

Also, according to the present invention, by adding and blending adjusting alloy powder containing a $Nd_2Fe_{17}$ phase obtained by the strip casting process by 60% or less of the total amount, to the R-Fe-B alloy powder containing the $R_2Fe_{14}B$ phase as the main phase obtained by the strip casting process, due to the reaction between the $Nd_2Fe_{17}$ phase in the adjusting alloy powder and the B-rich and Nd-rich phase in the main phase of R-Fe-B alloy powder, a B-rich phase and Nd-rich phase which deteriorate the permanent magnetic characteristics can be adjusted and decreased, the resulting magnet performance can be improved, and further, the oxygen content in the alloy powder can be reduced, thereby the alloy powder having the composition responsive to various magnetic characteristics is easily provided.

Furthermore, according to the present invention, by adding and blending the adjusting alloy powder containing an R-Co intermetallic compound phase obtained by the strip casting process by 60% or less of the total amount, to the R-Fe-B alloy powder containing the $R_2Fe_{14}B$ phase as the main phase obtained by the strip casting process, even when the liquid-phase sintering can not be effected only by the main phase of R-Fe-B alloy powder due to the shortage of the R-rich phase and B-rich phase, the R-Co intermetallic compound phase of the adjusting alloy powder is melted to supply the liquid phase for high densification, thus the resulting magnet performance can be improved, and further, the oxygen content in the alloy powder can be decreased and the alloy powder having the composition responsive to various magnetic characteristics is easily provided.

DETAILED DESCRIPTION OF THE PREFERRED EMBODIMENTS

Figure 1:
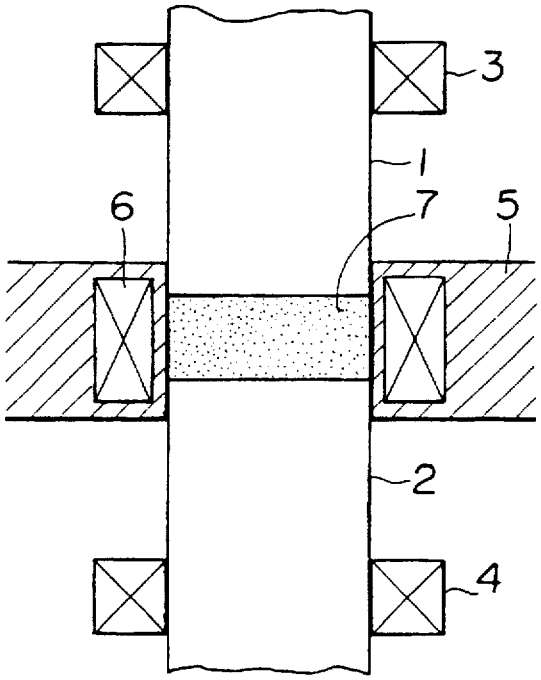
FIG. 1 is an explanatory view of a press machine in which a pulse magnetic field and a usual static magnetic field can be acted in common.

We have found out that, as the result of various studies carried out on a grinding process for the purpose of improving pulverizing efficiency, oxidation resistance, magnetic characteristics of R-Fe-B sintered magnet, and particularly, an iHc on an R-Fe-B alloy, in the case of producing an R-Fe-B cast piece having a fine and homogeneous structure by a strip casting process, and pulverizing alloy powders which are stabilized by dehydrogenation after a hydrogenation, pulverizing efficiency is improved about twice as much as the conventional pulverizing efficiency, and by molding, sintering and annealing the fine powder which has been oriented by applying a pulse magnetic field, a total value of a (BH) max value and an iHc value shows above 59, the squareness of demagnetization curve $\{(Br^2/4)/(BH)max\}$ value shows 1.01 to 1.045 and the iHc of a sintered magnet is improved.

That is, when an R-Fe-B alloy which is strip cast and has a specific composition having a structure in which an R-rich phase of specific thickness is finely dispersed, is subjected to the hydrogenation by the finely dispersed R-rich phase which produces hydrides and expands cubically, the alloy can be spontaneously decayed, and as a result, crystal grains constituting an alloy can be pulverized and a powder having a uniform grain distribution can be produced.

It is particularly important that, at this time, the R-rich phase is finely dispersed and the $R_2Fe_{14}B$ phase is fine. Besides, in a process of making the alloy ingot by using a usual mold, when the alloy composition is brought close to the stoichiometric composition of the $R_2Fe_{14}B$ phase, crystallization of an Fe primary crystal is unavoidable, causing a large deterioration of the pulverizing efficiency in the following process. And hence, though means for providing the heat treatment and eliminating α-Fe is taken to homogenize the alloy ingot, since the main phase crystal grains become coarse and segregation of the R-rich phase proceeds, iHc of the sintered magnet is difficult to improve.

It is also indispensable to uniform the easily magnetizing axial direction or to improve the degree of orientation of the main phase crystal grains, for achieving high magnetization and the improvement of the squareness of demagnetzation curve. Hence, a process of pressing the powder in a magnetic field is adopted.

However, in a coil or a power source disposed on a usual press machine (a hydraulic press and a mechanical press) for generating the magnetic field, only a magnetic field of 10 kOe to 20 kOe is generated at most, and the squareness of demagnetization curve $\{(Br^2/4)/(BH)max\}$ also assumes a value of 1.05 or more, thus it is difficult to achieve the theoretical (BH)max value (in this case, the squareness of demagnetization curve $\{(Br^2/4)/(BH)max\}$ is 1.00) expected from a Br value. Therefore, it is attempted to mold in the higher magnetic field, but for generating the higher magnetic field, the number of turns of the coil must be increased and also an apparatus necessitating the high power source must be made larger.

By analyzing the relationship between the magnetic field intensity at the time of pressing and Br of the sintered body, we have found out that the higher the magnetic field intensity is increased, the higher the magnetization and the more the squareness of demagnetization curve is improved. Thus, by using a pulse magnetic field capable of generating the strong magnetic field instantaneously, the higher magnetization and the higher the squareness of demagnetization curve are possible.

Meanwhile, we have found out that in the process of using the pulse magnetic field, it is important to instantaneously orient once by the pulse magnetic field, and it is possible to mold the powder by a iso-static press, and by combining the pulse magnetic field and the static magnetic field by an electromagnet, the press molding in the magnetic field is also possible.

That is, after casting a molten alloy consisting of 12 atomic % to 16 atomic % R (where R represents at least one kind of rare earth element containing Y), 4 atomic % to 8 atomic % B, 5000 ppm or less $O_2$, Fe (a portion of Fe can be substituted by one or two kinds of Co and Ni) and unavoidable impurities, into a cast piece whose main phase is an $R_2Fe_{14}B$ phase, by a strip casting process, the cast piece is contained in a container which can take in and discharge air, the air in the container is substituted with hydrogenation is dehydrogenated, thereafter pulverized into a fine powder of 1 μm to 10 μm mean particle size in an inert gas flow, the fine powder is filled into a mold and oriented by applying the pulse magnetic field of 10 kOe or more instantaneously, then molded, sintered and aged, thereby obtaining the permanent magnet materials having a total value A+B of a (BH) max value; A (MGOe) and an iHc value; B (kOe) of 95 or more and the squareness of demagnetization curve $\{(Br^2/4)/(BH)\ max\}$ value of 1.01 to 1.045.

While a $Nd_2Fe_{17}$ phase in an R-Fe alloy such as a Nd-Fe alloy is an intermetallic compound having an easily magnetizing direction in a C phase when a Curie point is in the vicinity of room temperature, and conventionally, in the R-Fe-B sintered permanent magnet, when the amount of B is less than 6 atomic %, for example, the $Nd_2Fe_{17}$ phase is produced in the magnet to weaken coercive force.

However, as the result of various studies, we have found out that in material powders in which a specific amount of R-Fe alloy powder containing the $R_2Fe_{17}$ phase such as the $Nd_2Fe_{17}$ phase is added to and blended with the R-Fe-B alloy powder containing the $R_2Fe_{14}B$ phase as the main phase, near eutectic temperature of 690° C. of Nd in the Nd-rich phase and the $Nd_2Fe_{17}$ phase in the R-Fe alloy powder in the grain boundary phase, for example, a reaction of $Nd+Nd_2Fe_{17}$ phase X liquid phase takes place, thereby this low melting point liquid phase accelerates the sintering of the R-Fe-B alloy powder.

Meanwhile, the adjusting alloy powder containing the $Nd_2Fe_{17}$ phase and the R-Fe-B alloy powder containing the $R_2Fe_{14}B$ phase as the main phase react as follows during the sintering, and act to increase the $R_2Fe_{14}B$ phase as the main phase.

$$13/17\ Nd_2Fe_{17}+1/4\ Nd_{1.1}Fe_4B_4+133/6800\ Nd \rightarrow Nd_2Fe_{14}B$$

That is, we have found out that in the above-mentioned reaction equation, since the $Nd_2Fe_{14}B$ phase is newly produced by the reaction between the $Nd_2Fe_{17}$ phase in the adjusting alloy powder and the B-rich phase and Nd-rich phase in the main phase R-Fe-B alloy powder, in the permanent magnet obtained only by the alloy powder containing the $R_2Fe_{14}B$ phase as the main phase of the conventional process, the amount of the B-rich phase and Nd-rich phase which is one of the factors deteriorating magnetic characteristics can be reduced at the time of sintering reaction.

Furthermore, from the fact that it is a large advantage from a production point of view to obtain material alloy powders which are easily pulverized when producing the R-Fe-B magnet by a powder metallurgical process, as the result of various studies on a process of producing the R-Fe-B permanent magnet material powders, we have found out that the R-Fe-B permanent magnet material powders are obtained by mixing a necessary amount of main phase alloy powder and adjusting alloy powder obtained by rapid cooling and solidifying the molten alloy by the strip casting process, to the main phase alloy powder containing the $R_2Fe_{14}B$ phase as the main phase and the adjusting alloy powder containing the $R_2Fe_{17}$ phase.

That is, reasons for producing the main phase alloy powder and adjusting alloy powder from the alloy obtained by the strip casting process in the present invention are that, by the strip casting, in the main phase alloy powder, the main phase alloy powder can be obtained from the alloy cast piece in which the $R_2Fe_{14}B$ main phase in fine and the B-rich phase and Nd-rich phase are sufficiently dispersed, besides, crystallization of Fe primary crystals is suppressed, and in the adjusting alloy powder, which can be obtained from the alloy cast piece in which the $R_2Fe_{17}$ phase is dispersed uniformly.

Particularly when the $R_2Fe_{14}B$ phase is fine and the B-rich phase and R-rich phase are uniformly dispersed in the main phase material powders, a pulverizing power is improved considerably at the time of producing the magnet, and a powder having uniform particle distributions can be obtained. Furthermore, when producing the magnet, since the crystal is fine, a high coercive force is obtained.

Meanwhile, an advantage of producing the adjusting alloy powder containing the $R_2Fe_{17}$ phase by the strip casting process is that, since the $R_2Fe_{17}$ phase can be made fine and dispersed sufficiently at the time of mixing with the main phase alloy powder, the reaction takes place uniformly. That is, in the usual alloy melting process using a mold, since α-Fe and the other R-Fe (Co) compound phase are crystallized on the resulting alloy ingot, for obtaining the stable material alloy powders, the alloy ingot must be heated and homogenized, causing the production cost of the alloy powder to increase and the $R_2Fe_{17}$ phase to grow. Furthermore, in the case of producing the adjusting alloy powder by a direct reducing and diffusing process, such problems are encountered that unreacted Fe grains remain or individual grain compositions differ from each other, and it is very difficult to homogenize the whole alloy powder. As the result of various studies on the above-mentioned findings, we have also found out that, in the material powders prepared by adding and blending a specific amount of R-Co alloy powder containing the R-Co intermetallic compound phase, for example, a $Nd_3Co$ phase and a $NdCo_2$ phase as the main phase, to the R-Fe-B alloy powder containing the $R_2Fe_{14}B$ phase as the main phase, by the reactions of $Nd+Nd_3Co$ phase $\leftarrow\leftrightarrows$ liquid phase in the vicinity of eutectic temperature 625° C. of Nd of the Nd-rich phase in the main phase alloy powder and $Nd_3Co$ in the R-Co alloy powder, the low melting point liquid phase accelerates the sintering of the R-Fe-B alloy.

That is, according to the present invention, it is possible to supply the amount of liquid phase necessary for sintering, as a result, the alloy powder made close to the stoichiometric composition of the $R_2Fe_{14}B$ phase can be liquid-phase sintered, thereby the magnet composition can be made close to the stoichiometric composition of the $R_2Fe_{14}B$ phase. In other words, in the case of producing the magnet only by the conventional alloy powder containing the $R_2Fe_{14}B$ phase as the main phase, the Nd-rich phase serving as a supply source of the liquid phase produces Nd-oxides during the process by indispensable material oxidation, thereby the amount of liquid phase necessary for sintering can not be secured, as a result, a high densification can not be sufficiently achieved, so that the composition must be set in advance with some margins, but the deviations can be solved by the present invention.

Particularly when the $R_2Fe_{14}B$ phase in the main phase material powders is fine and the B-rich phase and Nd-rich phase are dispersed uniformly, the pulverizing power is considerably improved at the time of producing the magnet, and the powder having uniform grain distributions can be produced. Furthermore, since the crystal is fine, a high coercive force can be obtained when producing the magnet. Particularly even when the alloy powder composition is made close to the stoichiometric composition of the $R_2Fe_{14}B$ phase, crystallization of the Fe primary crystal is eliminated and a uniform structure is obtained.

Furthermore, advantages of producing the adjusting alloy powder containing the R-Co intermetallic compound phase by the strip casting process are that, such problems as that, in the usual alloy melting process using the mold, the Co(Fe) phase and the other R-Co(Fe) compound phase are crystallized on the resulting alloy ingot, and the phases omnipresent locally, therefore, in order to obtain the stable material alloy powders, the alloy ingot must be heated and homogenized, causing increase in the production cost of the alloy powder, and that, in the case of producing the adjusting alloy powder by the direct reducing and diffusing process, unreacted Co and Fe grains remain or individual grain composition differs from each other, thus it is very difficult to homogenize that whole alloy powders, can be solved.

Magnetic characteristics of the R-Fe-B permanent magnet according to the present invention is that a total value A+B of 59 or more, in which A is a maximum energy product value (BH) max; (MGOe) and B is a coercive force iHc (kOe), when (BH) max is above 50 MGOe, iHc is more than 9 kOe, when (BH) max is above 45 MGOe, iHc is more than 14 kOe, and the squareness of demagnetization curve {(Br2/4(BH) max} value is 1.01 to 1.045; thus by selecting the composition and production conditions suitably, the necessary magnetic characteristics can be obtained.

In the present invention the cast piece of the magnet materials having a structure in which the $R_2Fe_{14}B$ phase having a specific composition and the R-rich phase are finely separated is produced by strip casting the molten alloy having a specific composition by a single roll process or a double roll process. The resulting cast piece is a sheet whose thickness is 0.03 mm to 10 mm, though the single roll process and the double roll process are used properly depending on the desired thickness of the cast piece, the double roll process is preferably adopted when the plate thickness is thick, and the single roll process is preferably used when the plate thickness is thin.

Reasons for limiting the thickness of the cast piece within 0.03 mm to 10 mm are that, when the thickness is below 0.03 mm a rapid cooling effect increases and the crystal grain size becomes smaller than 1 μm, thus easily oxidized when pulverized, which results in deterioration of the magnetic characteristics, and when the thickness exceeds 10 mm, a rapid cooling rate becomes slower, α-Fe is easily crystallized, the crystal grain size becomes larger and also the Nd-rich phase omnipresents, thus the magnetic characteristics is deteriorated.

In the present invention, a sectional structure of the RFe-B alloy having a specific composition obtained by the strip casting process is that the main phase $R_2Fe_{14}B$ crystal is finer than about one tenth or more as compared with that of the conventional ingot obtained by casting in a mold, for example, crystal sizes are 0.1 μm to 50 μm in a short axial direction and 5 μm to 200 μm in a long axial direction, and the R-rich phase is finely dispersed as surrounding the main phase crystal grain, even in the locally omnipresent region, the size is below 20 μm. Crystal grains of the main phase alloy powder and the adjusting alloy powder obtained by the strip casting process have the same properties.

By dispersing the R-rich phase finely below 5 μm, when the R-rich phase produces hydrides at the time of hydrogenation processing, volume expansion occurs uniformly for fractionization, so that the main phase crystal grain is fractionized by pulverization and the fine powder having a uniform grain distribution is obtained.

In the following, limited reasons of the compositions of the R-Fe-B permanent magnet and the alloy ingot in the present invention are described.

Rare earth elements R contained in the permanent magnet alloy ingot of the present invention contain yttrium (Y), and are the rare earth elements including light rare earths and heavy rare earths.

As R the light rare earths are sufficient, and particularly Nd and Pr are preferable. Though, usually, one kind of R is sufficient, practically, mixtures (mischmetal, didymium, etc.) of two kinds or more can be used from the reason of availability, and Sm, Y, La, Ce, Gd, etc., can be used as a mixture with other R, particularly, Nd, Pr and the like. The R is not necessarily be the pure rare earth elements, i.e., those containing unavoidable impurities in production may be used within an industrially available range.

R is an indispensable element of the alloy ingot for producing the R-Fe-B permanent magnet, whereby a high magnetic characteristics can not be obtained below 12 atomic %, particularly, a high coercive force can not be obtained, and when exceeding 16 atomic %, a residual magnetic flux density (Br) is lowered and the permanent magnet having a superb characteristics can not be obtained. And hence, the R is preferably within the range of 12 atomic % to 16 atomic %, the optimum range being 12.5 atomic % to 14 atomic %.

B is an indispensable element of the alloy ingot for producing the R-Fe-B permanent magnet, whereby the high coercive force (iHc) cannot be obtained below 4 atomic %, and when exceeding 8 atomic %, the residual magnetic flux density (Br) is lowered, so that a good permanent magnet can not be obtained. Hence, the B is preferably 4 atomic % to 8 atomic %, the optimum range being 5.8 atomic % to 7 atomic %.

In the case of Fe, the residual magnetic flux density (Br) is lowered below 76 atomic %, and when exceeding 84 atomic %, the high coercive force can not be obtained, so that Fe is restricted to 76 to 84 atomic %.

Also, though the reason for substituting a part of Fe with one or two kinds of Co and Ni is to obtain the effect of improving temperature characteristics and corrosion resistance of the permanent magnet, when one or two kinds of Co and Ni exceed 50% of Fe, the high coercive force can not be obtained and the good permanent magnet can not be obtained. Hence, the upper limit of Co and Ni is 50% of Fe.

The reason for restricting $0_2$ below 5000 ppm is that, when exceeding 5000 ppm, the R-rich phase is oxidized and the sufficient liquid phase is not produced at sintering, which results in lowering the density, so that the high magnetic flux density cannot be obtained and a weatherability is also deteriorated. Therefore, an optimum range of $0_2$ is between 200 to 3000 ppm.

When an apparent density of the permanent magnet material is below 7.45 g/cm$^3$, the high magnetic flux density cannot be obtained, and the magnet materials having a total value A+B of the (BH) max value; A (MGOe) and the i[]c value; B (kOe) above 59, which is a feature of the present invention, cannot be obtained.

Also, as the starting material powders in the present invention, besides the material powders of the magnet composition, for adjusting the amount of R, B and Fe to the magnet composition, it is also possible to use by blending the R-Fe-B alloy powder, containing the $R_2Fe_{14}B$ phase in which the amount of R, to be described later, is contained by 11 atomic % to 20 atomic % as the main phase, and the R-Fe-B alloy powder containing the $R_2Fe_{17}$ phase, in which the amount of R is below 20 atomic %.

As to the amount of B, the magnet composition can be adjusted by blending the main phase R-Fe-B alloy powder, in which the amount of B is contained by 4 atomic % to 12 atomic % or more, and the adjusting R-Fe-B alloy powder containing the $R_2Fe_{17}$ phase, in which the amount of B is contained below 6 atomic %, or the adjusting R-Fe alloy powder containing the $R_2Fe_{17}$ phase, in which B is not contained.

Furthermore, the magnet composition can be adjusted by blending the adjusting R-Co (can be substituted by Fe) alloy powder containing the R-Co intermetallic compound ($Nd_3$-Co, $NdCo_2$ and the like).

Though the presence of unavoidable impurities in industrial production is permissible besides R, B and Fe in the alloy cast piece of the present invention, by substituting a part of B by a total amount of 4.0 atomic % or less of, at least, one kind of 4.0 atomic % or less C, 3.5 atomic % or less P, 2.5 atomic % or less S and 3.5 atomic % or less C, improvement of the productivity and reduce the cost of the magnet alloy are possible.

Meanwhile, by adding, at least, one kind of Al of 9.5 atomic % or less, Ti of 4.5 atomic % or less, V of 9.5 atomic % or less, Cr of 8.5 atomic % or less, Mn of 8.0 atomic % or less, Bi of 5 atomic % or less, Nb of 12.5 atomic % or less, Ta of 10.5 atomic % or less, Mo of 9.5 atomic % or less, W of 9.5 atomic % or less, Sb of 2.5 atomic % or less, Ge of 7 atomic % or less, Sn of 3.5 atomic % or less, Zr of 5.5 atomic % or less and Hf of 5.5 atomic % or less, to the alloy powder containing the R, B, Fe alloys or the R-Fe-B alloy containing Co or the blended $R_2Fe_{14}B$ phase as the main phase, or to the adjusting alloy powder containing the $R_2Fe_{17}$ phase and the adjusting alloy powder containing the R-Co intermetallic compound phase, the high coercive force of the permanent magnet alloy is made possible.

In the R-B-Fe permanent magnet of the present invention, it is indispensable that the $R_2Fe_{14}B$ phase of the main phase of a crystal phase presents above 90%, preferably, above 94%. The RFe-B sintered magnet, which is produced in a large lot at present, has the $R_2Fe_{14}B$ phase of up to 90%, the high magnetic characteristics of the present invention, in which the value A +B is above 59, cannot be obtained below 90%.

A degree of orientation of the magnet of the present invention is calculated from the aforementioned equation 1, it is indispensable that the degree of orientation of the magnet is above 85% to hold the value A+B above 59, and when the degree of orientation is below 85%, the squareness of demagnetization curve is deteriorated and the high residual magnetic flux density (Br) is lowered, results in a low (BH) max value. The degree of orientation is preferably above 92%.

Though the squareness of demagnetization curve {($Br^2$/4)/(BH) max} theoretically shows a value of 1.00, since the abovementioned degree of orientation is disturbed inevitably in the practical permanent magnet material, though it is limited to 1.05 even after many improvement in the past, in the permanent magnet materials of the present invention obtained by the aforementioned specific process, the value of the squareness of demagnetization curve is 1.01 to 1.045.

In the following, restricted reasons of the composition of the main phase alloy and the adjusting alloy for the R-Fe-B permanent magnet materials are described.

For obtaining the main phase alloy powder containing the $R_2Fe_{14}B$ phase as the main phase to which the adjusting alloy powder containing the $R_2Fe_{17}$ phase is added and blended, when R is below 11 atomic %, residual iron where R and B do not diffuse increases, and when exceeding 20 atomic %, the R-rich phase increases and the oxygen content increases at pulverization, so that R is preferably 11 atomic % to 20 atomic %, more preferably, 13 atomic % to 16 atomic %.

The high coercive force (iHc) cannot be obtained when B is below 4 atomic %, and since the residual magnetic flux density (Br) is lowered when exceeding 12 atomic %, the good permanent magnet cannot be obtained, so that B is preferably 4 atomic % to 12 atomic %, more preferably, 6 atomic % to 10 atomic %.

The rest is composed of Fe and unavoidable impurities, Fe is preferably within the range of 65 atomic % to 82 atomic %. When Fe is below 65 atomic %, the rare earth elements and B become abundant relatively, and the R-rich phase and the B-rich phase increase, when exceeding 82 atomic %, the rare earth elements and B decrease relatively, and the residual Fe increases, results in the non-uniform alloy powder. Fe is preferably 74 atomic % to 81 atomic %.

Since one or two kinds of Co and Ni in the main phase alloy powder are substituted with Fe in the $R_2Fe_{14}B$ main phase to lower the coercive force, Co is preferably below 10 atomic % and Ni is preferably below 3 atomic %. However, in the case of substituting a part of Fe with the abovementioned Co or Ni, Fe is in the range of 55 atomic % to 72 atomic %.

For obtaining the adjusting alloy powder containing the $R_2Fe_{17}$ phase, the R-rich phase increases in production of the alloy powder and causes oxidation when the R exceeds 20 atomic %, thus R is preferably 5 to 15 atomic %. When B is below 6 atomic %, since only the $R_2Fe_{14}B$ phase presents and the amount of B in the main phase alloy powder can be adjusted, B is preferably below 6 atomic %.

Meanwhile, the rest is composed of Fe and unavoidable impurities, Fe is preferably 85 atomic % to 95 atomic %.

For obtaining the alloy powder containing the $R_2Fe_{14}B$ phase as the main phase, to which the R-Fe adjusting alloy powder containing the R-Co intermetallic compound phase is added and blended, since the residual iron, when R and B do not diffuse, increases when R is below 11 atomic %, and the R-rich phase increases and the oxygen content increases at pulverization when exceeding 15 atomic %, R is preferably 11 atomic % to 15 atomic %, more preferably, 12 atomic % to 14 atomic %.

Since the high coercive force (iHc) is not obtained when B is below atomic %, and the residual magnetic flux density (Br) is lowered when exceeding 12 atomic %, the good permanent magnet can not be obtained, so that B is preferably 4 atomic % to 12 atomic %, more preferably, 6 atomic % to 10 atomic %.

Meanwhile, the rest is composed of Fe and unavoidable impurities, Fe is preferably 73 atomic % to 85 atomic %. When Fe is below 73 atomic %, the rare earth elements and B become abundant relatively and the R-rich phase and the t-rich phase increase, when exceeding 85 atomic %, the rare earth elements and B decrease relatively and the residual Fe increases, results in the non-uniform alloy powder, thus Fe is, more preferably, 76 atomic % to 82 atomic %.

Since one or two kinds of Co and Ni in the main phase alloy powder are substituted with Fe in the $R_2Fe_{14}B$ main phase to deteriorate the coercive force, Co is preferably below 10 atomic % and Ni below 3 atomic %. However, in the case of substituting a part of Fe with the abovementioned Co or Ni, Fe is preferably 63 atomic % to 82 atomic %.

For obtaining the adjusting alloy powder containing the R-Co intermetallic compound phase, the R-rich phase increases to cause oxidation in production of the alloy powder when R exceeds 45 atomic %, so that R is preferably 10 to 20 atomic %.

Meanwhile, the rest is composed of Co and unavoidable impurities, Co is preferably 55 atomic % to 95 atomic %.

One or two kinds of Fe and Ni substituted with Co in the adjusting alloy powder are that, since the oxidation resistance of the adjusting alloy powder is deteriorated when the amount of Fe is increased, and the coercive force of the magnet is lowered when the amount of Ni is increased, Fe is preferably below 50 atomic % and Ni below 10 atomic %. However, in the case of substituting a part of Co with Fe or Ni, Co is preferably 5 atomic % to 45 atomic %.

In the present invention, the magnet composition alloy powder, the main phase alloy powder containing the $R_2Fe_{14}B$ phase as the main phase, and the adjusting alloy powder containing the $R_2Fe_{17}$ phase or the R-Co intermetallic compound phase, are produced by, for example, a known strip casting process by a single roll process or a double roll process.

Hydrogenation processing is that, for example, a cast piece cut into a predetermined size and having the thickness of 0.03 mm to 10 mm is inserted into a material case, which is covered and charged into a container which can be closed tightly. After closing the container tightly, the container is vacuumed sufficiently, thereafter $H_2$ gas of 200 Torr to 50 kg/cm$^2$ pressure is introduced to occlude hydrogenation by the cast piece.

Since the hydrogenation reaction is an exothermic reaction, by supplying the $H_2$ gas having a predetermined pressure for a fixed time, while providing a piping around the container for supplying cooling water to suppress the temperature rise in the container, the $H_2$ gas is absorbed and the cast piece is decayed spontaneously for pulverization. Meanwhile, the pulverized alloy is cooled and dehydrogenated in vacuum.

Since fine cracks are produced in the processed alloy powder grains, it can be pulverized by a ball mill, a jet mill and the like, and the alloy powder having the necessary grain size of 1 μm to 80 μm can be obtained.

In the present invention, air in the processing container may be substituted by inert gas beforehand, and then the inert gas is substituted by the $H_2$ gas.

The smaller the cut size of the cast piece the lower the $H_2$ gas pressure, and thought the cut cast piece absorbs $H_2$ and is pulverized even in the vacuum, the higher the pressure from the atmospheric pressure the easier the pulverization. However, the pulverization is deteriorated when below 200 Torr, and though it is preferable from a viewpoint of hydrogenation and pulverization to exceed 50 kg/cm$^2$, it is not so from a viewpoint of the apparatus and safety, so that the $H_2$ gas pressure is preferably 200 Torr to 50 kg/cm$^2$. From a viewpoint of mass production, it is preferably 2 kg/cm$^2$ to 10 kg/cm$^2$.

In the present invention, though the pulverization time by the hydrogenation varies depending on the closed container size, the size of the cut piece and the $H_2$ gas pressure, it takes more than 5 minutes.

The alloy powder pulverized by the hydrogenation is subjected to a primary dehydrogenation in vacuum after cooling. Meanwhile, when the pulverized alloy is heated at 100° C. to 750° C. in vacuum or in argon gas and subjected to a secondary dehydrogenation for 0.5 hours or longer, the $H_2$ gas in the pulverized alloy can be completely removed, and oxidation of the powder or a molded body due to a prolonged preservation is prevented, thereby deterioration of the magnetic characteristics of the resulting permanent magnet can be prevented.

Since the dehydrogenation processing of the present invention heating up to 100° C. or higher has a good dehydrogenating effect, the above-mentioned primary dehydrogenation in vacuum may be omitted, and the decayed powder may be directly dehydrogenated in vacuum or in an argon gas atmosphere at 100° C. or higher.

That is, after the hydrogenation and decaying reactions in the aforesaid container for hydrogenation reaction, the resulting decayed powder may be, subsequently, subjected to the dehydrogenation in the container atmosphere at 100° C. or higher. Or after the dehydrogenation in vacuum, the decayed powder is taken out from the container for pulverization, thereafter, the debydrogenation processing of the present invention heating up to 100° C. or higher in the container may be effected again.

When the heating temperature in the above-mentioned debydrogenation is below 100° C., it takes long time to remove $H_2$ remained in the decayed alloy powder thus it is not mass productive. When the temperature exceeds 750° C., a liquid phase is produced and the powder is solidified, making the pulverization difficult and deteriorating the moldability at pressing, thus it is not preferable when producing the sintered magnet.

When considering the sinterability of the sintered magnet, the preferable dehydrogenation temperature is 200° C. to 600° C. Though the processing time varies depending on the processing amount, it take 0.5 hours or longer.

Next, when pulverizing, it is effected by the jet mill in inert gas (e.g. $N_2$, Ar). It goes without saying that the ball mill and the attriter pulverizing using an organic solvent (e.g. benzene, toluene and the like) are possible.

Mean grain sizes of the powder at pulverization is preferably 1 μm to 10 μm. When below 1 μm, the pulverized powder becomes very active and susceptible to oxidation, thereby triggering ignition. When exceeding 10 μm, un-pulverized coarse grain remain, causing deterioration of the coercive force and the slow sintering rate results in a low density. The mean grain size of the fine powder is, more preferably, 2 to 4 μm.

For pressing using the magnetic field, the following process is proposed.

Pulverized powders are filled into a mold in an inert gas atmosphere. The mold may be made of, besides non-magnetic metals and oxides, organic compounds such as plastics, rubber and the like.

A charging density of the powder is, from a bulk density (charging density 1.4 g.cm$^3$) in a quiescent state of the powder, preferably within the range of the solidifying bulk density (charging density 3.0 g/cm$^3$) after tapping. Thus, the charging density is restricted to 1.4 to 3.0 g/cm$^3$.

A pulse magnetic field by an air-core coil and a capacitor power source is applied for orientation of the powder. At the time of orientation, the pulse magnetic field may be applied repeatedly, while compressing by upper and lower punches. The pulse magnetic field intensity is larger the better, at least, more than 10 kOe is necessary, preferably, 30 kOe to 80 kOe.

Figure 2:
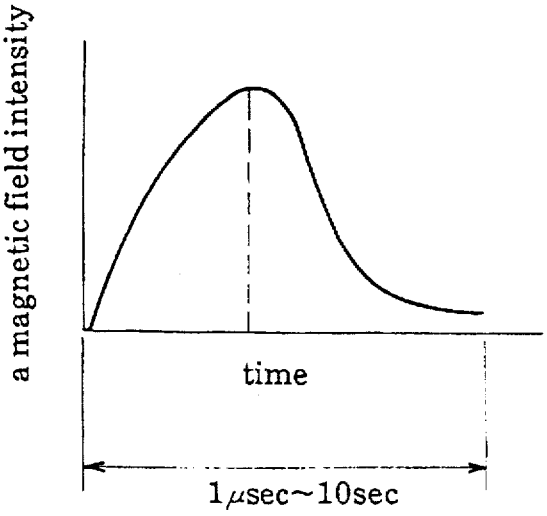
FIG. 2 is a graph showing the relationship between the time and a magnetic field intensity of a pulse magnetic field.

As shown in the graph of FIG. 2 showing the time and the magnetic field intensity, the pulse magnetic field time is preferably 1 μ sec to 10 sec, more preferably 5 μ sec to 100 m sec, and an applying frequency of the magnetic field is preferably 1 to 10 times, more preferably, 1 to 5 times.

The oriented powder may be solidified by a hydrostatic press. At this time, in the case of using the plastic mold, the hydrostatic pressing can be effected as it is. Pressure by the hydrostatic pressing process is preferably 0.5 ton/cm$^2$ to 5 ton/cm$^2$, more preferably, 1 ton/cm$^2$ to 3 ton/cm$^2$.

For continuously performing the orientation by the magnetic field and the pressing, it is possible to mold by a usual magnetic field pressing process, after embedding a coil generating the pulse magnetic field in a die, and using the magnetic field for orientation. Pressure by the magnetic field pressing process is preferably 0.5 ton/cm$^2$ to 5 ton/cm$^2$, more preferably, 1 ton/cm$^2$ to 3 ton/cm$^2$.

EXAMPLE

Embodiment 1

A sheet cast piece having the thickness of about 1 mm is prepared from a molten alloy having compositions of Nd 13.0—B 6.0—Fe 81 obtained by melting in a high frequency melting furnace, by using a double-roll type strip caster including two copper rolls of 200 mm diameter. Crystal grain sizes of the cast piece are 0.5 μm to 15 μm in a short axial direction and 5 μm to 80 μm in a long axial direction, an R-rich phase which is finely separated into about 3 μm presenting as surrounding a main phase. The oxygen content is 300 ppm.

The cast piece of 1000 g cut into a 50 mm square or smaller is contained in a closed container which can take in and discharge air, $N_2$ gas is introduced into the container for 30 minutes and after substituting with air, $H_2$ gas of 3 kg/cm$^2$ pressure is fed into the container for 2 hours to decay the cast piece spontaneously by hydrogenation, then retaining in vacuum at 500° C. for 5 hours for dehydrogenation, thereafter cooling to room temperature and grinding into 100 mesh.

Next, the 800 g of coarse grain is pulverized in a jet mill to obtain an alloy powder of 3.5 μm mean grain sizes. The resulting alloy powder is filled into a rubber mold and a pulse magnetic field of 60 kOe is applied instantaneously for orientation, thereafter subjected to hydrostatic pressing at 2.5 T/cm$^2$ by a hydrostatic press.

A molded body taken out from the mold is sintered at 1090° C. for 3 hours to obtain a permanent magnet after the one hour annealing at 600° C. Magnetic characteristics and density, crystal grain size, degree of orientation, the squareness of demagnetization curve main phase amount and oxygen content are shown in Table 1.

Embodiment 2

The molten alloy having the same composition as the Embodiment 1 is strip casted to obtain a sheet cast piece having the sheet thickness of about 0.5 μm.

Crystal grain sizes in the cast piece are 0.3 μm to 12 μm in a short axial direction and 5 μm to 70 μm in a long axial direction, an R-rich phase finely separated into about 3 μm presenting as surrounding a main phase. The cast piece is pulverized by the jet mill at the same condition as the Embodiment 1 to obtain the alloy powder of about 3.4 μm mean grain size. The powder is molded in the magnetic field of about 12 kOe, after, first, oriented in the pulse magnetic field of about 30 kOe, by a press machine, in which, as shown in FIG. 1, static magnetic field coils 3, 4 are disposed around upper and lower punches 1, 2, and a pulse magnetic field coil 6 is provided in a die 5 so as to act the pulse magnetic field and the usual magnetic field commonly to material powders 7. Thereafter, the molded body is sintered and annealed at the same condition as the Embodiment 1.

Magnetic characteristics and density, crystal grain size, degree of orientation, the squareness of demagnetization curve, main phase amount and $0_2$ content of the resulting permanent magnet are shown in Table 1.

Embodiment 3

As same as the Embodiment 1, an alloy of Nd 13.5—Dy 0.5—B 6.5—Co 1.0—Fe 78.5 is strip casted to obtain a sheet cast piece. The cast piece of 100 g cut into a 50 mm square or smaller is decayed spontaneously by the hydrogenation as same as the Embodiment 1, and dehydrogenated in vacuum for 6 hours. Then, after coarse grinding, pulverized in a jet mill to obtain the powder of 3.5 μm mean grain size.

The resulting powder is oriented in the pulse magnetic field as same as the Embodiment 1, and a molded body obtained by the hydrostatic press is sintered similarly. Magnetic characteristics and density, crystal grain size, degree of orientation, the squareness of demagnetization curve, main phase amount and $0_2$ content are shown in Table 1.

Comparative Example 1

The powder obtained at the same condition as the Embodiment 1 is pressed and molded in the magnetic field of about 12 koe by the usual magnetic field press machine in dried state, then sintered and annealed at the same condition as the Embodiment 1. However, oxidation occurs during the pressing, thus densification to a sufficient sinter density is impossible, so that the magnetic characteristics cannot be measured and only the density and $0_2$ content are measured.

Comparative Example 2

The coarse powder obtained at the same condition as the Embodiment 1 is pulverized by the ball mill, using toluene as a solvent, to obtain the fine powder of 3.5 μm mean grain size, which is pressed and molded in the magnetic field of about 12 kOe by the usual magnetic field press machine in a wet state, then sintered and annealed at the same condition as the Embodiment 1.

Magnetic characteristics and density, crystal grain size, degree of orientation, the squareness of demagnetization curve, main phase amount $0_2$ content of the resulting permanent magnet are shown in Table 1.

Comparative Example 3

A molten alloy having the composition of Nd 14—B 6.0—Fe 80 obtained by melting in a high-frequency melting furnace is casted in an iron mold. When a structure of a resulting alloy ingot was observed, crystallization of a Fe primary crustal is seen, so that heated at 1050° C. for 10 hours for homogeneous processing.

Crystal grain sizes of a resulting ingot are 30 to 150 μm in a short axial direction and 100 μm to several mm in a long axial direction, and an R-rich phase is segregated in the size of about 150 μm locally.

After coarsely grinding the alloy ingot, the coarse powder is obtained by the hydrogenation and dehydrogenation by the same process as the Embodiment 1. Furthermore, the coarse powder is pulverized by the jet mill at the same condition as the Embodiment 1, and the resulting alloy powder of about 3.7 μm mean grain size is pressed and molded in the magnet field of about 12 kOe for sintering and heat treatment at the same conditions as the Embodiment 1. Magnetic characteristics and density, crystal grain size, degree orientation, the squareness of demagnetization curve, main phase amount and $0_2$ content of the resulting permanent magnet are shown in Table 1.

Comparative Example 4

After coarsely grinding a strip casted piece having the same composition and thickness as the Embodiment 1 into the size of 50 mm or smaller, 1000 g of the coarse powder is ground, for one four in a stamp mill, into coarse powders of 100 mesh, without the hydrogenation and dehydrogenation processing, then pulverized in the jet mill to obtain the alloy powder of 3.8 μm mean grain size.

The alloy powder is pressed in the magnetic field of about 12 kOe, sintered and annealed to obtain the permanent magnet. Magnetic characteristics and density, crystal grain size, degree of orientation, the squareness of demagnetization curve, main phase amount and $0_2$ content of the resulting permanent magnet are shown in Table 1.

Comparative Example 5

An alloy having the composition of Nd 13.5—Dy 0.5—B 6.5—Co 1.0—Fe 78.5 is casted by the same method as the Comparative Example 3. Since a Fe primary crystal is crystallized in the resulting alloy ingot, which is subjected to the heat treatment at 1050° C. for 6 hours. After coarsely grinding the alloy ingot, it is subjected to hydrogenation the same as in Embodiment 1, and then dehydrogenated in vacuum. The coarse powder is ground coarsely and pulverized in the jet mill to obtain the powder of 3.7 μm mean grain size.

The powder is pressed in the magnetic field of about 12 kOe, then sintered and heated at the same condition as the Embodiment 1. Magnetic characteristics and density, crystal grain size, degree of orientation, the squareness of demagnetization curve, main phase amount and $0_2$ content of the resulting permanent magnet are shown in Table 1.

Comparative Example 6

After casting an alloy having the composition of Nd 16.5—B 7—Fe 76.5 into an ingot as same as the Comparative Example 3, without liquefaction, the ingot is coarsely ground, and the same as in Comparative Example 4, coarsely ground in the stamp mill, thereafter pulverized in the jet mill to obtain the fine powder of 3.7 μm mean grain size.

Furthermore, the fine powder is pressed in the magnetic field of about 12 kOe, then sintered and annealed at the same condition as the Embodiment 1. Magnetic characteristics and density, crystal grain size, degree of orientation, the squareness of demagnetization curve, main phase amount and $0_2$ content of the resulting permanent magnet are shown in Table 1.

TABLE 1

| | Br (kG) | Hc (kOe) | (BH) max (MGOe) | iHc (kOe) |
|---|---|---|---|---|
| Embodiment 1 | 14.8 | 10.50 | 53.1 | 10.58 |
| Embodiment 2 | 14.5 | 11.0 | 50.8 | 11.50 |
| Embodiment 3 | 13.8 | 12.9 | 45.9 | 15.00 |
| Comparative Example 1 | — | — | — | — |
| Comparative Example 2 | 13.3 | 9.9 | 42.0 | 9.98 |
| Comparative Example 3 | 13.4 | 10.3 | 42.7 | 10.70 |
| Comparative Example 4 | 13.1 | 10.0 | 40.5 | 10.30 |
| Comparative Example 5 | 12.9 | 11.3 | 39.3 | 13.50 |
| Comparative | 12.2 | 10.5 | 34.4 | 11.5 |

TABLE 1-continued

Example 6

| | Density ρ (g/cm³) | crystal grain size (μm) | degree of orientation f (%) | angularity {Br2/4)/(BH)max} | main phase amount (1-a) (%) | oxygen content (ppm) |
|---|---|---|---|---|---|---|
| Embodiment 1 | 7.55 | average 6 | 96 | 1.031 | 96.5 | 1500 |
| Embodiment 2 | 7.57 | average 6 | 95.5 | 1.035 | 94.0 | 2500 |
| Embodiment 3 | 7.59 | average 6 | 93.2 | 1.038 | 92.7 | 2000 |
| Comparative Example 1 | 6.8 | — | — | — | — | 6500 |
| Comparative Example 2 | 7.40 | average 11 | 87.5 | 1.053 | 96.5 | 4200 |
| Comparative Example 3 | 7.44 | average 15 | 88.4 | 1.052 | 95.5 | 5000 |
| Comparative Example 4 | 7.43 | average 12 | 86.5 | 1.060 | 95.5 | 5500 |
| Comparative Example 5 | 7.44 | average 14 | 87.2 | 1.058 | 92.7 | 5000 |
| Comparative Example 6 | 7.50 | average 15 | 85.8 | 1.081 | 86.0 | 6500 |

Embodiment 4

As materials for a main phase alloy powder by a strip casting process, 340 g a Nd metal of 99% purity, 8 g of a Dy metal of 99% purity, 65.5 g of a Fe-B alloy containing 20% B, and 600 g of an electrolytic iron of 99% purity are used, and melted in an Ar atmosphere so as to obtain an alloy having a predetermined composition, then casted by a strip casting process using copper rolls to obtain a cast piece having the plate thickness of about 2 mm. The cast piece is coarsely ground by a hydrogenation processing, and pulverized by a jaw crusher, a disk mill and the like to obtain 800 g of powder of about 10 μm mean grain size.

The resulting powder consisting of 14.9 atomic % Nd, 0.1 atomic % Pr, 0.3 atomic % Dy, 8.0 atomic % B and Fe, is observed by an x-ray diffraction EPMA, as a result, it is confirmed that it is about 800 ppm. As the result of EPMA observation on the cast piece structure, the $R_2Fe_{14}B$ main phase is about 5 μm in a short axial direction and 20 to 80 μm in a long axial direction, and the R-rich phase is finely dispersed as surrounding the main phase.

As materials of adjusting alloy powders containing an $R_2Fe_{17}$ phase by the strip casting process, 250 g of a Nd metal of 99% purity, 11 g of a Dy metal of 99% purity, 730 g of an electrolytic iron of 99% purity and 20 g of a Fe-B alloy containing 20.0% B are used, to obtain a cast piece having the plate thickness of about 2 mm as same as the main phase alloy. Furthermore, the powder is prepared by the same processing as the main phase alloy. A composition of the resulting powder is a 0.8 atomic % Nd, 0.1 atomic % Pr, 0.4 atomic % dy, 2.4 atomic % B and Fe.

As the result of EPMA observation on the cast piece structure, it consists of the $R_2Fe_{17}$ phase, partly $R_2Fe_{14}B$ and the Nd-rich phase, α-Fe is not confirmed. The oxygen content is 850 ppm.

Using the above-mentioned two kinds of material powders, the 30% adjusting alloy powder is blended with the main phase alloy powder. The material powders are fed into a grinder such as a jet mill and the like to pulverize into about 3 μm, the resulting fine powder is filled into a rubber mold, and is subjected to hydrostatic pressing at 2.5 T/cm² by a hydrostatic press machine, after applying a pulse magnetic field of 60 kOe instantaneously for orientation, thereby to obtain a molded body of 8 mm×15 mm×10 mm.

The molded body is sintered at 1100° C. in the Ar atmosphere for 3 hours, and annealed at 550° C. for one hour. Magnetic characteristics of the resulting magnet are shown in Table 2.

Comparative Example 7

As materials for the main phase alloy powder, they are the same as in Embodiment 4, 340 g of a Nd metal of 99% purity, 8 g of a Dy metal of 99% purity, 600 g of an electrolytic iron of 99% purity and 65.5 g of a FE-B alloy containing 20% B are used, molten in the Ar atmosphere and casted in an iron mold. The resulting alloy ingot is pulverized into the powder of 10 μm mean grain size by the same method as the Embodiment 1. As the result of composition analysis, it consists of 14.9 atomic & Nd, 0.1 atomic % Pr, 0.3 atomic % Dy, 8.0 atomic % B and Fe. The oxygen content is about 900 ppm.

As the result of EPRA observation on the alloy ingot structure, the $R_2Fe_{14}B$ main phase is about 50 μm in a short axial direction and about 500 μm in a long axial direction, the R-rich phase omnipresents by 50 μm locally. Besides, α-Fe of 5 to 10 μm is seen in the main phase.

As adjusting materials containing the $R_2Fed_7$ phase, 200 g $Md_2O_3$ (98% purity), 12 g of $Dy_2O_3$ (99% Purity), 65 g of a Fe-B alloy containing 20% B and 600 g of iron powders of 99% purity are used, to which 150 g of metal Ca of 99% purity and 25 g of $CaCl_2$ anhydride are mixed, and charged into a stainless steel container to obtain the adjusting alloy powder by a direct reducing and diffusing process at 950° C. for 8 hours in the Ar atmosphere. As the result of component analysis of the resulting alloy powder, it consists of 10.8 atomic % Nd, 0.1 atomic % Pr, 0.4 atomic percent Dy, 2.4 atomic % B and Fe. The oxygen content is 1500 ppm. Using the aforementioned two kinds of material powders, 30% adjusting alloy powder is blended with the main phase alloy powder and pulverized into about 3 μm in the grinder such as the jet mill and the like. The resulting fine powder is oriented in the magnetic field of about 10 kOe, and molded at about 1.5 T/cm² pressure at right angles to the magnetic field to obtain a molded body of 8 mm×15 mm×10 mm.

The molded body is sintered in the Ar atmosphere at 1100° C. for 3 hours, and annealed at 550° C. for one hour. Magnetic characteristic of the resulting magnet are also shown in Table 2.

Comparative Example 8

The main phase alloy powder of the Comparative Example 1 is used, and as materials for the adjusting alloy powder, 250 g of a Nd metal of 99% purity, 11 g of Dy metal of 99% purity, 730 g of an electrolytic iron of 99% purity and 20 g of a Fe-B alloy containing 20.0 g B-are used, melted in the Ar atmosphere and casted in the iron mold. As the result of observation on the structure of the resulting alloy ingot, it is confirmed that a large amount of α-Fe is crystallized, so that the homogenizing processing is performed at 1000° C. for 12 hours.

As the result of component analysis made by the same method as the Embodiment 4, it is consisting of 10.8 atomic % Nd, 0.1 atomic % Pr, 0.4 atomic % Dy, 2.4 atomic % B and Fe.

Using the above-mentioned two kinds of material powders, 30% adjusting alloy powder is blended with the main phase alloy powder to prepare a magnetic as same as the Comparative Example 7. Magnetic characteristics of the resulting magnet are shown in Table 2.

Comparative Example 9

As materials, 315 g of a Nd metal of 99~o purity, 8.5 g of a Dy metal of 99% purity, 52 g of a Fe-B alloy containing 20% B and 636 g of an electrolytic iron of 99% purity are used, melted in the Ar atmosphere so as to obtain an alloy having a predetermined composition, then a cast piece having the plate thickness of about 2 mm is obtained by the strip casting process using copper rolls. Furthermore, the cast piece is coarsely ground by the hydrogenation processing, then pulverized in the jaw crusher, disk mill and the like to obtain 800 g of powders of 10 μm mean grain size.

As the result of EPMA observation on the resulting powder, it consists of 13.8 atomic % Nd, 0.1 atomic % Pr, 0.3 atomic % Dy, 6.3 atomic % B and Fe. The oxygen content is about 800 ppm. As the result EPMA observation also on the cast piece structure, the $R_2Fe_{14}B$ main phase is about 6 μm in a short axial direction and 20 to 80 μm in a long axial direction, the R-rich phase presenting finely as surrounding the main phase.

Using the alloy powder by the strip casting process, a magnet is produced as same as the Comparative Example 7. Magnetic characteristics of the resulting magnet are also shown in Table 2.

TABLE 2

| | composition | magnetic characteristics | | | |
|---|---|---|---|---|---|
| | | Br | Hc | (BH) max | iHc |
| Embodiment 4 | 13.8 Nd-0.1 Pr-0.3 Dy-6.3 B-bal. Fe | 14.0 | 12.5 | 47.5 | 13.5 |
| Comparative Example 7 | 13.8 Nd-0.1 Pr-0.3 Dy-6.3 B-bal. Fe | 13.2 | 12.0 | 40.7 | 12.5 |
| Comparative Example 8 | 13.8 Nd-0.1 Pr-0.3 Dy-6.3 B-bal. Fe | 13.2 | 11.9 | 40.B | 12.0 |
| Comparative Example 9 | 13.8 Nd-0.1 Pr-0.3 Dy-6.3 B-bal. Fe | 13.3 | 123 | 42.3 | 12.9 |

| | Density ρ (g/cm³) | crystal grain size (μm) | degree of orientation f (%) | angularity {Br²/4)/(BH)max} | main phase amount (1-a) (%) | oxygen content (ppm) |
|---|---|---|---|---|---|---|
| Embodiment 4 | 7.56 | average 8 | 94.5 | 1.32 | 92.8 | 3000 |
| Comparative Example 7 | 7.53 | average 15 | 89.2 | 1.07 | 92.8 | 5000 |
| Comparative Example 8 | 7.53 | average 16 | 89.2 | 1.068 | 92.8 | 5500 |
| Comparative Example 9 | 7.54 | average 8 | 89.9 | 1.053 | 92.8 | 4000 |

Embodiment 5

By the same process as the Embodiment 4, 800 g of main phase alloy powder of 10 μm mean grain size having a composition different from the Embodiment 4 is obtained. The resulting powder is consisting of 14 atomic % Nd, 0.1 atomic % Pr, 0.5 atomic % Dy, 8 atomic % B and Fe. As the result of observation by the x-ray diffraction EPMA, it is mostly the $R_2Fe_{14}B$ phase. The oxygen content is about 80 ppm. As the result of EPMA observation on the cast piece structure, the $R_2Fe_{14}B$ main phase is about 0.5 to 15 μm in a short axial direction and 5 to 90 μm in a long axial direction, the R-rich phase dispersing finely as surrounding the main phase.

As materials of the adjusting alloy powder containing the $R_2Fe_{,7}$ phase, 125 g of a Nd metal of 99% purity, 5 g of a Dy metal of 99% purity and 275 g of an electrolytic iron of 99% purity are used, and a cast piece having the plate thickness of about 2 mm is obtained by the strip casting process as same as the main phase alloy. Furthermore, the powder is prepared by the same processing as the main phase alloy. The composition of the resulting powder is 11.0 atomic % Nd, 0.05 atomic % Pr, 0.4 atomic % Dy and Fe.

As the result of EPMA observation on the cast piece structure, it consists of the $R_2Fe_{17}$ phase, partly $R_2Fe_{14}B$, and the R-rich phase, α-Fe is not seen. The oxygen content at 10 μm mean grain size is 700 ppm.

Using the above-mentioned two kinds of material powders, 25 % adjusting alloy powder is blended with the main phase alloy powder. The material powders are charged into a grinder such as a jet mill to pulverize into about 3 μm, then filled into a rubber mold, and the resulting fine powder is subjected to the hydrostatic pressing at 2.5 T/cm² pressure by a iso-static press machine to obtain a molded body of 8 mm×15 mm×10 mm, after applying the pulse magnet field of 60 kOe instantaneously for orientation.

The molded body is sintered in the Ar atmosphere at 1100° C. for 3 hours, and annealed at 550° C. for one hour. Magnetic characteristics of a resulting magnet are shown in Table 3.

Comparative Example 10

As the main phase alloy powder, the alloy having the same composition as the Embodiment 5 is casted in the iron mold to obtain the powder of about 10 μm mean grain size by the same method as the Embodiment 4. Compositions are 14 atomic % Nd, 0.1 atomic % Pr, 0.5 atomic % Dy, 8 atomic % B and Fe, the oxygen content is about 900 ppm. As the result is about 50 μm in a short axial direction and about 500 μm in a long axial direction, the R-rich phase omnipresents by 50 μm locally. Meanwhile, a part of 5 to 10 μm α-Fe presents in the main phase.

The adjusting alloy powder containing the $R_2Fe_{17}$ phase is produced by the same direct reducing and diffusing process as the Comparative Example 7, by using 280 g of $Nd_2O_3$ (purity 98%), 12 g of $Dy_2O_3$ (purity 99%) and 750 g of iron powder (purity 99%). Components are 11.0 atomic % Nd, 0.05 atomic % Pr, 0.9 atomic % Dy and Fe. The oxygen content is 1500 ppm.

Using the above-mentioned two kinds of material powders, 25% adjusting alloy powder is blended with the main phase alloy powder, and charged into the jet mill and the like to pulverize into about 3 μm. The resulting fine powder is oriented in the magnet field of about 10 kOe, and molded at about 1.5 T/cm² pressure at right angles to the magnetic field to obtain a molded body of 8 mm×15 mm×10 mm.

The molded body is sintered in the Ar atmosphere at 1100° C. for 3 hours, and annealed at 550° C. for one hour. Magnetic characteristics of the resulting magnet are also shown in Table 3.

Comparative Example 11

Using the main phase alloy powder of the Comparative Example 10, the adjusting alloy powder is prepared, by melting 350 g of a Nd metal, 10 g of a Dy metal and 750 g of an electrolytic iron of 99% purity in the Ar atmosphere, and casted in the iron mold. As the result of observation on the resulting alloy ingot, since a large amount of α-Fe is crystallized, the homogenizing processing is effected at 1000° C. for 12 hours. As the result of component analysis, it is consisting of 11.0 atomic % Nd, 0.05 atomic % Pr, 0.4 atomic % Dy and Fe.

Using the above-mentioned two kinds of material powders, 25% adjusting alloy powder is blended with the main phase alloy powder to produce a magnet as same as the Comparative Example 10. Magnetic characteristics of the resulting magnet is also shown in Table 3.

Comparative Example 12

As the materials, 300 g of a Nd metal, 13 g of a Dy metal, 50 g of a Fe-B alloy containing 20% B and 645 g of an electrolytic iron of 99% purity are used, and melted in the Ar atmosphere so as to obtain an alloy having a predetermined composition, then by the strip casting process using copper rolls, a cast piece having the plate thickness of about 2 mm is obtained. Furthermore, the cast piece is pulverized by the hydrogenation, jaw crusher, disk mill and the like to obtain 800 g of powder of about 10 μm mean grain size.

The resulting powder consists of 13.3 atomic % Nd, 0.1 atomic % Pr, 0.5 atomic % Dy, 6 atomic % B and Fe. The oxygen content is about 800 ppm. As the result of EPMA observation on the cast piece structure, the $R_2Fe_{14}B$ main phase is about 0.3 to 15 μm in a short axial direction and about 5 to 90 μm in a long alloy direction, the R-rich phase presenting finely as surrounding the main phase.

Using the alloy powder by the strip casting process, a magnet same as the Comparative Example 10 is produced. Magnetic characteristics of the resulting magnet are also shown in Table 3.

TABLE 3

| | composition | magnetic characteristics Br | Hc | (BH) max | iHc |
|---|---|---|---|---|---|
| Embodiment 5 | 13.8 Nd-0.1 Pr-0.5 Dy-6 B-bal. Fe | 14.2 | 12.8 | 48.5 | 14.5 |
| Comparative Example 10 | 13.8 Nd-0.1 Pr-0.5 Dy-6 B-bal. Fe | 13.3 | 11.5 | 41.5 | 13.5 |
| Comparative Example 11 | 13.8 Nd-0.1 Pr-0.S Dy-6 B-bal. Fe | 13.3 | 11.8 | 41.7 | 13.6 |
| Comparative Example 12 | 13.8 Nd-0.1 Pr-0.5 Dy-6 B-bal. Fe | 13.4 | 11.6 | 42.6 | 14.0 |

| | Density ρ (g/cm³) | crystal grain size (μm) | degree of orientation f (%) | angularity {Br²/4)/(BH)max} | main phase amount (1-a) (%) | oxygen content (ppm) |
|---|---|---|---|---|---|---|
| Embodiment 5 | 7.57 | average 6 | 95.9 | 1.039 | 94.8 | 2000 |
| Comparative Example 10 | 7.56 | average 14 | 89.8 | 1.066 | 94.0 | 5000 |
| Comparative Example 11 | 7.55 | average 15 | 89.8 | 1.060 | 94.0 | 5500 |
| Comparative Example 12 | 7.56 | average 8 | 90.5 | 1.054 | 94.0 | 3800 |

Embodiment 6

As materials of the main phase alloy powder by the strip casting process, 260 g of a Nd metal of 99% purity, 23 g of a Dy metal of 99% purity, 68.5 g of a Fe-B alloy containing 20% B and 655 g of an electrolytic iron of 99% purity are used, and melted in the Ar atmosphere so as to obtain an alloy having predetermined composition, then casted by the strip casting process using copper rolls to obtain a cast piece having the plate thickness of about 2 mm. The cast piece is coarsely ground by the hydrogenation processing, and pulverized by a jaw crusher, a disk mill and the like to obtain 800 g of powder of about 10 μm mean grain size.

The resulting powder consisting of 11 atomic % Nd, 0.1 atomic % Pr, 1.0 atomic % Dy, 8 atomic % B and Fe is observed by an x-ray diffraction EPMA, as a result, it is confirmed that it is mostly consisting of a $R_2Fe_{14}B$ phase. The oxygen content is about 800 ppm. As the result of EPMA observation on the cast piece structure, the $R_2Fe_{14}B$ main phase is about 0.5 to 1.5 μm in a short axial direction and 5 to 90 μm in a long axial direction, and the R-rich phase is finely dispersed as surrounding the main phase.

As material of the adjusting alloy powder containing an R-Co intermetallic compound phase by the strip casting process, 490 g of a Nd metal, 2.6 g of a Dy metal and 500 g of Co of 99% purity are used, to obtain a cast piece having the plate thickness of about 2 mm as same as the main phase alloy. Meanwhile, by the same processing as the main phase alloy, powder is prepared. A composition of the resulting powder is 27.0 atomic % Nd, 0.5 atomic % Pr, 1.3 atomic % Dy and Co.

As the result of EPMA observation the cast piece structure, it consists of the $R_3Co$ phase and partly the $R_2Co_{17}$ phase, and the $R_3Co$ phase is dispersed finely. The oxygen content in the powder of 10 μm mean grain size is 700 ppm.

Using the above-mentioned two kinds of material powders, 20% adjusting alloy powder is blended with the main phase alloy powder. The material powders is charged into a grinder such as a jet mill and the like to pulverize into about 3 μm, which is filled into a rubber mold and is subjected to hydrostatic pressing at 2.5 T/cm² by a hydrostatic press machine, after applying a pulse magnetic field of 60 kOe instantaneously for orientation, thereby to obtain a molded body of 8 mm×15 mm×10 mm.

The molded body is sintered at 1100° C. in the Ar atmosphere for 3 hours, and annealed at 550° C. for one hour. Magnetic characteristics of the resulting magnet are shown in Table 4.

Embodiment 7

Magnetic characteristics of the magnet obtained by blending 10% adjusting alloy powder with the main phase alloy powder prepared in the Embodiment 1, and magnetizing by the same process as the Embodiment 6, are shown in Table 4.

Comparative Example 13

For the main phase alloy powder, as same as the Embodiment 6, 260 g of a Nd metal of 99% purity, 26 g of a Dy metal of 99% purity, 665 g of an electrolytic iron of 99% purity and 68.5 g of a Fe-B alloy containing 20.0% B are used, melted in the Ar atmosphere and casted in the iron mold. The resulting alloy ingot is pulverized into powder of about 10 μm mean grain size by the same method as the Embodiment 1. As the result of component analysis, the powder consists of 11 atomic % Nd, 0.1 atomic % Pr, 1.0 atomic % Dy, 8 atomic % B and Fe, the oxygen content is about 900 ppm.

As the result of EPMA observation on the alloy ingot structure, the $R_2Fe_{14}B$ main phase is about 50 μm in a short axial direction and about 500 μm in a long axial direction, the R-rich phase omnipresents by 50 μm locally. A part of α-Fe of 5 to 10 μm present in the main phase.

As adjusting materials containing the R-Co intermetallic compound phase, by the direct reducing and diffusing process, 550 g of $Nd_2O_3$ (98% purity), 29 g of $Dy_2O_3$ (99% purity) and 500 g of Co powder of 99% purity are used, to which 350 g of metal Ca of 99% purity and 60 g of $CaCl_2$ anhydride are mixed, and charged into a stainless steel container to obtain the alloy powder in the Ar atmosphere at 750° C. for 8 hours. As the result of component analysis, the resulting alloy powder is consisting of 27.0 atomic % Nd, 0.6 atomic % Pr, 1.3 atomic % Dy and Co, the oxygen content is 1500 ppm.

Using the above-mentioned two kinds of material powders, 20% adjusting alloy powder is blended with the main phase alloy powder, and charged into the grinder such as the jet mill and the like to pulverize into about 3 μm. The resulting fine powder is oriented in the magnetic field of about 10 kOe, and molded at about 1.5 T/cm$^2$ pressure at right of 8 mm×15 mm×10 mm.

The molded body is sintered in the Ar atmosphere at 1100° C. for 3 hours, and annealed at 550° C. for one hour. Magnetic characteristics of the resulting magnet are also shown in Table 4.

Comparative Example 14

Using the main phase alloy of the Embodiment 13, the adjusting alloy powder is prepared by melting.

490 g of a Nd metal, 26 g of Dy metal and 500 g of Co of 99% purity in the Ar atmosphere, and casted n the iron mold. As the result of observation on the resulting alloy ingot structure, a large amount of Co is crystallized, so that the homogenizing processing is effected at 800° C. for 12 hours. As the result of component analysis, it consists of 11.0 atomic % Nd, 0.6 atomic % Pr, 1.3 atomic % Dy and Co.

Using the above-mentioned two kinds of material powders, 20% adjusting alloy powder is blended with the main phase alloy powder to produce a magnet as same as the Comparative Example 13. Magnetic characteristics of the resulting magnet are also shown in Table 4.

Comparative Example 15

As materials, 305 g of a Nd metal, 26 g of a Dy metal, 55 g of a Fe-B alloy containing 20% B, 100 g of Co of 99% purity, and 525 g of an electrolytic iron of 99% purity are used, melted in the Ar atmosphere so as to obtain an alloy having a predetermined composition, and by the strip casting process using copper rolls, a cast piece having the plate thickness of about 2 mm is obtained. The cast piece is coarsely ground by the hydrogenation processing and pulverized by the jaw crusher, disk mill and the like to obtain 800 g of powder of about 10 μm grain size.

The resulting powder consists of 13.5 atomic % Nd, 0.1 atomic % Pr, 1.0 atomic % Dy, 6.7 atomic % B, 11.3 atomic % Co and Fe. The oxygen content is about 800 ppm. As the result of EPMA observation on the cast piece structure, the $R_2(Fe, Co_{14})B$ phase is about 0.3 to 1.5 μm in a short axial direction and about 5 to 90 μm in a long axial direction, the R-rich phase and the R-Co phase presenting finely as surrounding the main phase.

Using the alloy powder by the strip casting process, a magnet is produced as same as the Comparative Example 3. Magnetic characteristics of the resulting magnet are also shown in Table 4.

TABLE 4

| | composition | magnetic characteristics Br | Hc | (BH) max | iHc | density g/cm$^3$ |
|---|---|---|---|---|---|---|
| Embodiment 6 | 13.5 Nd-0.1 Pr-1.0 Dy-6.7 B-6.5 Co bal. Fe | 13.3 | 12.4 | 42.5 | 17.0 | 7.62 |
| Embodiment 7 | 12.3 Nd-0.1 Pr-1.0 Dy-7.3 B-11.3 Co bal. Fe | 13.5 | 12.5 | 44.0 | 16.8 | 7.61 |
| Comparative Example 13 | 13.5 Nd-0.1 Pr-1.0-Dy-6.7 B-11.3 Co-bal. Fe | 12.0 | 11.0 | 34.0 | 15.8 | 7.56 |
| Comparative Example 14 | 13.5 Nd-0.1 Pr-1.0 Dy-6.7 B-11.3 Co-bal. Fe | 12.2 | 11.1 | 35.0 | 15.5 | 7.55 |
| Comparative Example 15 | 13.5 Nd-0.1 Pr-1.0 Dy-6.7 B-11.3 Co-bal. Fe | 12.2 | 11.2 | 35.2 | 16.5 | 7.58 |

| | Density ρ (g/cm$^3$) | crystal grain size (μm) | degree of orientation f (%) | angularity {Br$^2$/4}/(BH)max} | main phase amount (1-a) (%) | oxygen content (ppm) |
|---|---|---|---|---|---|---|
| Embodiment 6 | 7.62 | average 5 | 94 | 1.04 | 91 | 2800 |
| Embodiment 7 | 7.61 | average 6 | 95.5 | 1.036 | 94 | 2200 |
| Comparative Example 13 | 7.56 | average 14 | 85.7 | 1.056 | 91 | 4800 |
| Comparative Example 14 | 7.55 | average 15 | 87.1 | 1.063 | 91 | 5000 |
| Comparative Example 15 | 7.58 | average 6 | 87.1 | 1.057 | 91 | 3500 |

What is claimed is:

1. A process for producing an R-Fe-B permanent magnet comprising the steps of:

casting a molten alloy consisting of 12 to 16 atomic % of R, wherein R is at least one rare-earth element including Y, 4 to 8 atomic % of B, not more than 5000 ppm of $O_2$ and a balance of Fe, wherein a portion of said Fe is replaced by either one or both of Co and Ni, and unavoidable impurities, into cast pieces by a strip casting process for quenching the molten alloy with a single roll or double rolls, the cast pieces of which are composed of fine crystals having an $R_2F_{14}B$ phase as a principal phase and have a thickness of 0.03 mm–10 mm, depositing said cast pieces in a container having a capability of intaking air therein and exhausting air therefrom, supplying $H_2$ gas into said container to replace air in the container with $H_2$ gas so that the cast pieces absorb $H_2$ gas and be transformed into a powdered alloy, subjecting the thus obtained powdered alloy to a degassing treatment of $H_2$ gas and subsequently to a pulverization in an inert gas stream to obtain pulverized alloy powder having an average particle diameter of 1 μm to 10 μm, filling the pulverized alloy powder in a mold to orient the alloy powder by momentarily applying a pulse magnetic field of at least 10 KOe thereto, and molding the thus-oriented alloy powder and sintering and aging the thus-molded alloy powder to obtain the permanent magnet having the sum A+B of the magnetic characteristic A, (BH)max(MGOe) and B, iHc(kOe) of at least 59.0 and a squareness of a demagnetizing curve $\{BR^2/4/(BH)max\}$ of 1.01 to 1.045.

2. A process of producing R-Fe-B permanent magnet materials in accordance with claim 1, wherein said molten alloy consists of 12.5 atomic % to 14 atomic % R, wherein, R is at least one rare earth element including Y, 5.8 atomic % to 7 atomic % B, 200 ppm to 3000 ppm or less $O_2$, Fe, a portion of said Fe being replaced by either one or both of Co and Ni, and unavoidable impurities.

3. A process of producing R-Fe-B permanent magnet materials in accordance with claim 1 or claim 2, wherein the alloy powder contains, as an additive, at least one element selected from the croup consisting of 9.5 atomic % or less of Al, 4.5 atomic % or less of Ti, 9.5 atomic % or less of V, 8.5 atomic % or less of Cr, 8.0 atomic % or less of Mn, 5 atomic % or less of Bi, 12.5 atomic % or less of Nb, 10.5 atomic % or less of Ta, 9.5 atomic % or less of Mo, 9.5 atomic % or less of W, 2.5 atomic % or less of Sb, 7 atomic % or less of Ge, 3.5 atomic % or less of Sn, 5.5 atomic % or less of Zr and 5.5 atomic % or less of Hf.

4. A process for producing an R-Fe-B permanent magnet comprising the steps of:

casting a Principal phase molten alloy consisting of 11 to 20 atomic % of R, wherein R is at least one rare-earth element including Y, 4 to 12 atomic % of B, and a balance of Fe, wherein a portion of said Fe is replaced by either one or both of Co and Ni, and unavoidable impurities, into principal phase cast pieces by a strip casting process for quenching the molten alloy with a single roll or double rolls, the principal phase cast pieces of which are composed of fine crystals having an $R_2F_{14}B$ phase as a principal phase and having a thickness of 0.03 mm–10 mm, casting an adjusting phase molten alloy consisting of not more than 20 atomic % of R, wherein R is at least one rare-earth element including Y, and a balance of Fe, a portion of said Fe is replaced by either one or both of Co and Ni, and unavoidable impurities, into adjusting cast pieces by said strip casting process, the adjusting cast pieces of which are composed of fine crystals having an $R_2F_{17}$ phase and having a thickness of 0.03 mm–10 mm, depositing the thus-obtained cast pieces in a container having a capability of intaking air therein and exhausting air therefrom, supplying $H_2$ gas into said container to replace air in the container with $H_2$ gas so that the cast pieces can absorb $H_2$ gas and be transformed into powdered alloy, subjecting the thus obtained powdered alloy to a degassing treatment of $H_2$ gas and subsequently to a pulverization in an inert gas stream to obtain the principal phase alloy powder and adjusting alloy powder having an average particle diameter of 1 μm to 10 μm, mixing the pulverized principal phase alloy powder and the pulverized adjusting alloy powder, filling the mixed alloy powder in a mold to orient it by momentarily applying a pulse magnetic field of at least 10 KOe thereto, and molding the thus-oriented alloy powder and sintering and aging the thus-molded alloy to obtain the permanent magnet having the sum A+B of the magnetic characteristic A, (BH)max(MGOe) and B, iHc(KOe) of at least 59.0 and a squareness of a demagnetizing curve $\{BR^2/4/(BH)max\}$ of 1.01 to 1.045.

5. A process of producing R-Fe-B permanent magnet materials in accordance with claim 4, wherein said principal phase molten alloy consists of 13 atomic % to 16 atomic % R, wherein R is at least one rare earth element including Y, 6 atomic % to 10 atomic % B, Fe, a portion of Fe being replaced by either one or both of Co and Ni, and unavoidable impurities.

6. A process of producing R-Fe-B permanent magnet materials in accordance with claim 4, wherein said adjusting molten alloy consists of 20 atomic % or less of R, wherein R is at least one rare earth element including Y, 6 atomic % or less of B, Fe, a portion of said Fe being replaced by either one or both of Co and Ni, and unavoidable impurities.

7. A process of producing R-Fe-B permanent magnet materials in accordance with claim 6, wherein said adjusting molten alloy consists of 5 atomic % to 15 atomic % of R, wherein R is at least one rare earth element including Y, 6 atomic % or less of B, Fe, a portion of said Fe being replaced by either one or both of Co and Ni, and unavoidable impurities.

8. A process of producing R-Fe-B permanent magnet materials in accordance with claim 4 or claim 6, wherein an R amount and a B amount of said principal phase molten alloy containing an $R_2Fe_{14}B$ phase as a principal phase are respectively 13 atomic % to 16 atomic % and 6 atomic % to 10 atomic %.

9. A process of producing R-Fe-B permanent magnet materials in accordance with claim 4 or claim 6, wherein an Fe in said principal phase molten metal containing an $R_2Fe_{14}B$ phase as a principal phase is substituted by either one or both of up to 10 atomic % Co and up to 3 atomic % Ni.

10. A process of producing R-Fe-B permanent magnet materials in accordance with claim 4 or claim 6, wherein R in said adjusting alloy powder containing an $R_2Fe_{14}B$ phase is 5 atomic % to 15 atomic %.

11. A process of producing R-Fe-B permanent magnet materials in accordance with claim 4, wherein a blending amount of said adjusting alloy powder relative to said principal phase alloy powder is 0.1% to 40%.

12. A process for producing R-Fe-B permanent magnet comprising the steps of:

casting a molten alloy consisting of 11 to 15 atomic % of R, wherein R is at least one rare-earth element including Y, 4 to 12 atomic % of B, and a balance of Fe, wherein a portion of said Fe is replaced by either one or both of Co and Ni, and unavoidable impurities, into principal phase cast pieces by a strip casting process for quenching the molten alloy with a single roll or double rolls, the principal phase cast pieces of which are composed of fine crystals having an $R_2F_{14}B$ phase as a principal phase and having a thickness of 0.03 mm–10 mm, casting a molten alloy consisting of not more than 45 atomic % of R, wherein R is at least one rare-earth element including Y, and balance being Co, a part of the Co is replaced by either one or both of Fe and Ni, and unavoidable impurities, into adjusting cast pieces by said strip casting process, the adjusting pieces of which are composed of fine crystals including an R-Co intermetallic compound phase and having a thickness of 0.03 mm–10 mm, depositing the thus-obtained cast pieces in a container having a capability of intaking air therein and exhausting air therefrom, supplying $H_2$ gas into said container to replace air in the container with $H_2$ gas so that the cast pieces can absorb $H_2$ gas and be transformed into powdered alloy, subjecting the thus-obtained powdered alloy to a degassing treatment of $H_2$ gas and subsequently to a pulverization in an inert gas stream to obtain the principal phase alloy powder and adjusting alloy powder having an average particle diameter of 1 μm to 10 μm, mixing the pulverized principal phase alloy powder and the pulverized adjusting alloy powder, filling the mixed alloy powder in a mold to orient it by momentarily applying a pulse magnetic field of at least 10 KOe thereto, and molding the thus-oriented alloy powder and sintering and aging the thus-molded alloy to obtain the permanent magnet having the sum A+B of the magnetic characteristic A, (BH)max(MGOe) and B, iHc(KOe) of at least 59.0 and a squareness of demagnetizing curve $\{BR^2/4/(BH)max\}$ of 1.01 to 1.045.

13. A process of producing R-Fe-B permanent magnet materials in accordance with claim 12, wherein the R amount and the B amount of said principal phase molten alloy containing an $R_2Fe_{14}B$ phase as a principal phase, are respectively 12 atomic % to 14 atomic % and 6 atomic % to 10 atomic %.

14. A process of producing R-Fe-B permanent magnet materials in accordance with claim 12, wherein Fe in said principal phase molten alloy containing an $R_2Fe_{14}B$ phase as a principal phase, is substituted by either one or both of up to 10 atomic % Co and up to 3 atomic % Ni.

15. A process of producing R-Fe-B permanent magnet materials in accordance with claim 12, wherein R of said adjusting alloy powder containing an R-Co intermetallic compound phase is 10 atomic % to 20 atomic %.

16. A process of producing R-Fe-B permanent magnet materials in accordance with claim 12, wherein the amount of Fe and Ni substituted with Co in said adjusting alloy powder is respectively up to 50 atomic % and up to 10 atomic %.

17. A process of producing R-Fe-B permanent magnet materials in accordance with claim 4, claim 6 or claim 12, wherein said main phase alloy powder and/or said adjusting alloy powder contains, as an additive, at least one element selected from the group consisting of 9.5 atomic % or less of Al, 4.5 atomic % or less of Ti, 9.5 atomic % or less of V, 8.5 atomic % or less of Cr, 8.0 atomic % or less of Mn, 5 atomic % or less of Bi, 12.5 atomic % or less of Nb, 10.5 atomic % or less of Ta, 9.5 atomic % or less of Mo, 9.5 atomic % or less of W, 2.5 atomic % or less of Sb, 7 atomic % or less of Ge, 3.5 atomic % or less of Sn, 5.5 atomic % or less of Zr and 5.5 atomic % or less of Hf.

18. A process of producing R-Fe-B permanent magnet materials in accordance with claim 4, claim 6 or claim 12, wherein a blending amount of said adjusting alloy powder relative to said principal phase alloy powder is 60% or less.

19. A process of producing R-Fe-B permanent magnet materials in accordance with claim 1, claim 2, claim 4, claim 6, or claim 12 wherein a cast piece crystal obtained by a strip casting process is 0.1 μm to 50 μm in a short axial direction and 5 μm to 200 μm in a long axial direction, and an R-rich phase is finely dispersed below 5 μm.

20. A process of producing R-Fe-B permanent magnet materials in accordance with claim 1, claim 2, claim 4, claim 6 or claim 12, wherein an $H_2$ gas pressure of hydrogenation processing is 200 Torr to 50 kg/cm$^2$.

21. A process of producing R-Fe-B permanent magnet materials in accordance with claim 20, wherein said $H_2$ gas pressure is 2 kg/cm$^2$ to 10 kg/cm$^2$.

22. A process of producing R-Fe-B permanent magnet materials in accordance with claim 1, claim 2, claim 4, claim 6 or claim 12, wherein a dehydrogenation processing is to heat decayed alloy powder at 100° C. to 750° C. for 0.5 hours or longer.

23. A process of producing R-Fe-B permanent magnet materials in accordance with claim 22, wherein a dehydrogenation processing is to heat decayed alloy powder at 200° C. to 600° C. for 0.5 hours or longer.

24. A process of producing R-Fe-B permanent magnet materials in accordance with claim 1, claim 2, claim 4, claim 6 or claim 12, wherein mean grain sizes of pulverized powder are 2 μm to 4 μm.

25. A process of producing R-Fe-B permanent magnet materials in accordance with claim 1, claim 2, claim 4, claim 6 or claim 12, wherein said mold is composed of a material selected from the group consisting of non-magnetic metals, oxides and organic compounds.

26. A process of producing R-Fe-B permanent magnet materials in accordance with claim 1, claim 2, claim 4, claim 6 or claim 12, wherein a packing density of powder packed in the mold is 1.4 g/cm$^3$ to 3.0 g/cm$^3$.

27. A process of producing R-Fe-B permanent magnet materials in accordance with claim 1, claim 2, claim 4, claim 6 or claim 12, wherein powder is oriented by applying a pulse magnetic field by an air-core coil and a capacitor power source.

28. A process of producing R-Fe-B permanent magnet materials in accordance with claim 1, claim 2, claim 6 or claim 12, wherein pulse magnetic field intensity is 30 kOe to 80 kOe.

29. A process of producing R-Fe-B permanent magnet materials in accordance with claim 1, claim 2, claim 4, claim 6 or claim 12, wherein a one-waveform of the pulse magnetic field is 1 μsec. to 10 sec.

30. A process of producing R-Fe-B permanent magnet materials in accordance with claim 29, wherein a one-waveform time of the pulse magnetic field is 5 μsec to 100 m sec.

31. A process of producing R-Fe-B permanent magnet materials in accordance with claim 1, claim 2, claim 4, claim 6 or claim 12, wherein an applying frequency of a pulse magnetic field is 1 to 10 times.

32. A process of producing R-Fe-B permanent magnet materials in accordance with claim 31, wherein an applying frequency of a pulse magnetic field is 1 to 5 times.

33. A process of producing R-Fe-B permanent magnet materials in accordance with claim 1, claim 2, claim 4, claim 6 or claim 12, wherein molding after an orientation is effected by a hydrostatic pressing process.

34. A process of producing R-Fe-B permanent magnet materials in accordance with claim 33, wherein a pressure by a hydrostatic pressing process must by 0.5 ton/cm$^2$ to 5 ton/cm$^2$.

35. A process of producing R-Fe-B permanent magnet materials in accordance with claim 34, wherein a pressure by a hydrostatic pressing process must be 1 ton/cm$^2$ to 3 ton/cm$^2$.

36. A process of producing R-Fe-B permanent magnet materials in accordance with claim 1, claim 2, claim 4, claim 6 or claim 12, wherein molding after an orientation is effected by a magnetic field pressing process.

37. A process of producing R-Fe-B permanent magnet materials in accordance with claim 36, wherein a pressure by a magnetic field pressing process must be 0.5 ton/cm$^2$ to 5 ton.cm$^2$.

38. A process of producing R-Fe-B permanent magnet materials in accordance with claim 37, wherein a pressure by a magnetic field pressing process must be 1 ton/cm$^2$ to 3 ton/cm$^2$.

* * * * *